US008925151B2

(12) United States Patent
Salice

(10) Patent No.: US 8,925,151 B2
(45) Date of Patent: Jan. 6, 2015

(54) DECELERATED HINGE FOR FURNITURE

(71) Applicant: Arturo Salice S.p.A., Novedrate (IT)

(72) Inventor: Luciano Salice, Carimate (IT)

(73) Assignee: Arturo Salice, S.p.A., Novedrate (IT)

( * ) Notice: Subject to any disclaimer, the term of this patent is extended or adjusted under 35 U.S.C. 154(b) by 0 days.

(21) Appl. No.: 14/366,982

(22) PCT Filed: May 7, 2013

(86) PCT No.: PCT/EP2013/059447
§ 371 (c)(1),
(2) Date: Jun. 19, 2014

(87) PCT Pub. No.: WO2014/000931
PCT Pub. Date: Jan. 3, 2014

(65) Prior Publication Data

US 2014/0345081 A1 Nov. 27, 2014

(30) Foreign Application Priority Data

Jun. 26, 2012 (IT) ..... MI2012A1122

(51) Int. Cl.
*E05F 1/08* (2006.01)
*E05F 3/20* (2006.01)
*E05F 5/02* (2006.01)

(52) U.S. Cl.
CPC .. *E05F 3/20* (2013.01); *E05F 5/027* (2013.01)
USPC ..... 16/286

(58) Field of Classification Search
CPC ..... E05Y 2900/20; E05Y 2900/202; E05Y 2900/204; E05Y 2900/208; E05Y 2201/20; E05Y 2201/21; E05F 5/006; E05F 5/02; E05D 11/1021; E05D 11/1042; E05D 11/105; E05D 11/1064; E05D 7/04; E05D 7/0407; E05D 7/125; E05D 3/142
USPC ..... 16/286, 287, 288, 54, 56, 366, 370, 16/371, 354; 188/282.1, 282.2, 381, 266, 188/283, 280, 281
See application file for complete search history.

(56) References Cited

U.S. PATENT DOCUMENTS 5,269,043 A * 12/1993 Yang ..... 16/68
7,065,833 B2 * 6/2006 Kropf ..... 16/286

(Continued)

FOREIGN PATENT DOCUMENTS

DE 202010015536 3/2012
WO WO2010108203 9/2010

(Continued)

OTHER PUBLICATIONS

International Search Report dated Jun. 7, 2013; International Application No. PCT/EP2013/059447; International Filing Date: May 7, 2013; 4 pages.

(Continued)

*Primary Examiner* — Chuck Mah
(74) *Attorney, Agent, or Firm* — Blank Rome LLP

(57) ABSTRACT

A hinge (10) for mounting a door (14) on a piece of furniture, comprising a hinge arm (12) fixable to a fixed part (11) of the piece of furniture and a box (13) fixable to a door (14) of the piece of furniture, swingably connected to each other; the hinge further comprises a linear-type decelerating device (22) arranged inside the box (13), having a fluid-type decelerating cylinder (23) and return spring means (24), operatively connected with each other, which extend parallel to and spaced apart from each other. The fluid-type decelerating cylinder (23) is arranged in proximity to a side wall (18') of the box (13) and the return spring means (24) are arranged in proximity to the opposite aide wall (18") of the box (13).

18 Claims, 4 Drawing Sheets

(56) References Cited

U.S. PATENT DOCUMENTS

| | | | | |
|---|---|---|---|---|
| 7,328,484 | B2 * | 2/2008 | Salice | 16/354 |
| 7,600,295 | B2 * | 10/2009 | Zimmer | 16/286 |
| 8,186,014 | B2 * | 5/2012 | Pecar et al. | 16/286 |
| 8,225,459 | B2 * | 7/2012 | Waltemate et al. | 16/366 |
| 8,418,317 | B2 * | 4/2013 | Wu et al. | 16/50 |
| 8,505,165 | B2 * | 8/2013 | Domenig et al. | 16/286 |
| 8,650,711 | B1 * | 2/2014 | Chen et al. | 16/54 |
| 2011/0291538 | A1 * | 12/2011 | Brunnmayr | 312/326 |
| 2012/0126677 | A1 * | 5/2012 | Ahlfeld | 312/326 |
| 2013/0139353 | A1 * | 6/2013 | Brunnmayr | 16/319 |

FOREIGN PATENT DOCUMENTS

| | | |
|---|---|---|
| WO | WO2012010350 | 1/2012 |
| WO | WO2012024711 | 3/2012 |

OTHER PUBLICATIONS

Written Opinon dated Jun. 7, 2013; International Application No. PCT/EP2013/059447; International Filing Date: May 7, 2013; 6 pages.

English abstract; German Application No. DE202010015536; 1 page.

English abstract; International Publication No. WO2012024711; 1 page.

English abstract; International Publication No. WO2010108203; 1 page.

* cited by examiner

DECELERATED HINGE FOR FURNITURE

BACKGROUND OF THE INVENTION

The invention relates to a decelerated hinge for furniture doors, in particular a hinge suitable for being applied on pieces of furniture provided with a face frame for fixing the hinges themselves.

In the furniture industry, for the purpose of supporting furniture doors in a swingable fashion, use is conventionally made of hinges comprising a fixed part connectable to the body of the piece of furniture and a movable part, consisting of a box, connectable to the door.

In the case of pieces of furniture with a face frame for fixing the hinges, typically used on the American market, the hinges themselves generally require the box to be connected to an arm of the fixed part by means of a single articulation pin.

In order to maintain the door in a closed position, the hinges further comprise suitable spring means, which can be, for example, in the form of two torsion springs placed in proximity to the side walls of the box, or else in the form of a leaf spring fixed inside the box in a central position and loaded in such a way as to draw the arm of the fixed part in closing direction of the hinge.

In order to decelerate the closing movement of the hinge, in the presence of side torsion closure springs, a linear decelerating device can be placed inside the box; depending on the available space left by the closure springs themselves, said device comprises a fluid-type decelerating cylinder arranged centrally and two return springs placed on opposite sides of the decelerating cylinder itself.

In the presence, on the other hand, of a leaf closure spring, or of any other constructive element placed in a central position in the box, it is impossible, due to lack of space, to house the known decelerating device inside the box itself, or in any case it would be necessary to further reduce the dimensions of such a decelerating device, already critical due to the little available space.

SUMMARY OF THE INVENTION

The main object of the present invention is therefore to provide a decelerated hinge for furniture doors, in particular for pieces of furniture provided with a face frame for fixing, which has a decelerating device configured so as to be suitable for being associated with closing means placed centrally in the hinge box.

Another object of the present invention is to provide a hinge of the kind considered, which is capable of exerting an effective decelerating action along a particularly extensive swing arc of the hinge.

A further object of the present invention is to provide a hinge of the kind considered, in which the decelerating device is of simple construction and features components that can be easily assembled together.

All the above is achievable by means of a hinge for mounting a door on a piece of furniture, comprising:

a hinge arm fixable to a fixed part of the piece of furniture;

a box fixable to a door of the piece of furniture, the box being swingably connected to said hinge arm at a rear longitudinal end of the box and having side walls longitudinally extending on opposite sides of the box starting from said rear end;

spring means for closing the hinge; and a linear-type decelerating device arranged inside the box, the device comprising a fluid-type decelerating cylinder and return spring means operatively connected with each other, characterized in that said fluid-type decelerating cylinder and said return spring means extend parallel to and spaced apart from each other, said fluid-type decelerating cylinder being arranged in proximity to a first of said side walls of the box and said return spring means arranged in proximity to the opposite side wall of the box.

Additional features of the present invention are moreover defined in the subsequent claims.

BRIEF DESCRIPTION OF THE DRAWING FIGURES

The features and advantages of the present invention will be more apparent from the description that follows of a preferred but non-limiting embodiment of the hinge with a decelerating device for pieces of furniture, with reference to the appended figures, in which.

DETAILED DESCRIPTION OF THE PREFERRED EMBODIMENT

Figure 1:
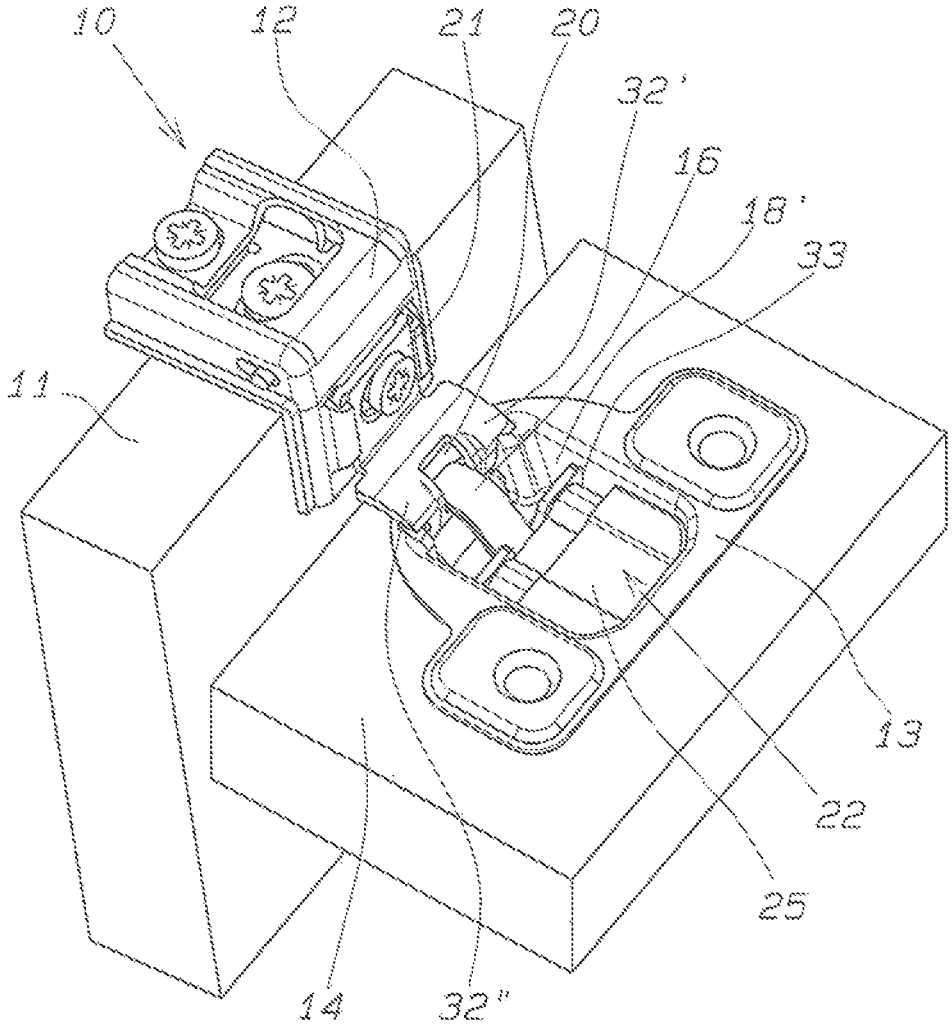
FIG. 1 is a perspective view of the hinge according to one embodiment of the invention.
Figure 2:
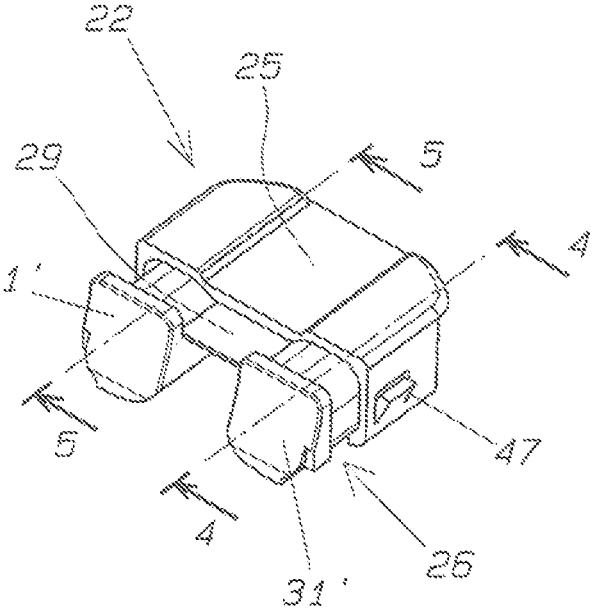
FIG. 2 is a perspective view of the decelerating device of the hinge of FIG. 1.

The hinge according to the present invention, indicated overall in the appended figures with the numerical reference 10, is particularly suitable for being configured for an application to American-type pieces of furniture provided with a face frame 11 on which the hinges are fixed.

This type of hinge 10 generally comprises an arm 12 for fixing the hinge itself to a fixed part of the piece of furniture, in particular to the face frame 11, and a box 13 for fixing to a door 14 of the piece of furniture.

Figure 3:
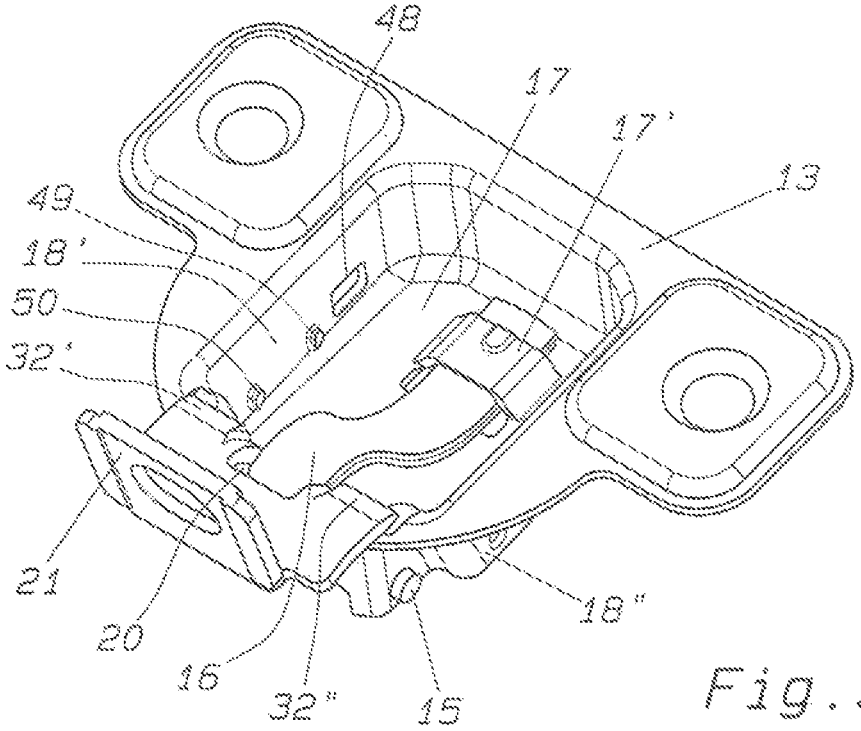
FIG. 3 is a perspective view of the box of hinge with the central closing means acting upon the end part of the hinge arm.
Figure 7:
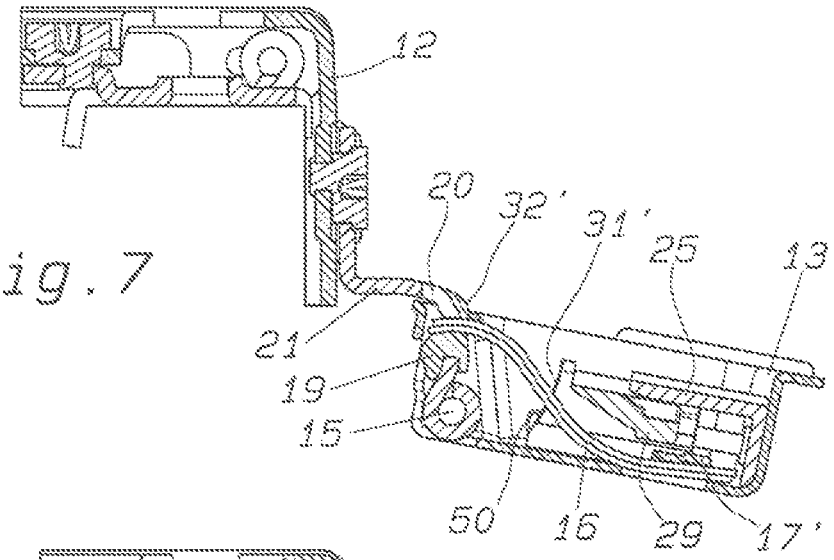
FIG. 7 is a median longitudinal sectional view of the hinge of FIG. 1 in an open position.
Figure 9:
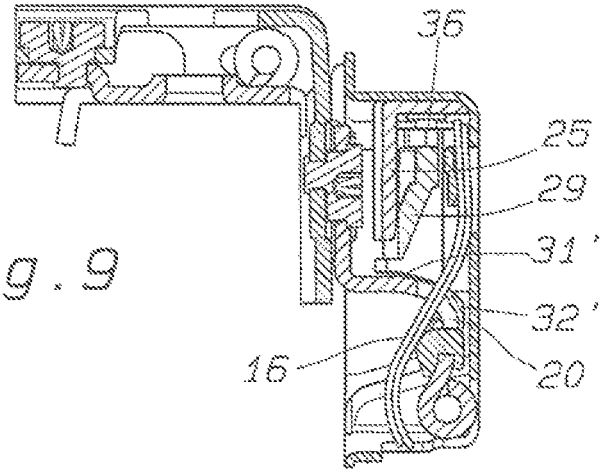
FIG. 9 is a median longitudinal sectional view of the hinge of FIG. 1, wherein the hinge is represented in a closed position.

As better illustrated in FIGS. 3 and 7, the box 13 is swingably connected to the fixing arm 12 at a rear longitudinal end of the box 13 itself, preferably by means of a single swing pin 15 that extends transversely relative to the longitudinal axis of the fixing arm 12, in such a way that the box 13 can rotate between an open position of the door, illustrated in FIG. 7, and a closed position of the door, illustrated in FIG. 9, under the action of spring closing means of a known type, for example at least a leaf spring 16, arranged centrally and longitudinally inside the box 13.

As illustrated in FIG. 3, the hinge box 13 comprises a bottom wall 17 and side walls 18', 18" which extend longitudinally on opposite sides of the box starting from the rear end.

In a front area, the bottom wall 17 has a bridge 17', which can be obtained by cutting and plastic deformation of the metal sheet, and which defines an insertion seat for a front end of the leaf spring 16; the rear end of the spring 16 is instead curved toward the swing pin 15 and rests on a cam 19 inserted on the lower edge of an opening 20 formed in a front part 21 of the hinge arm 12.

The hinge 10 further comprises a linear-type a decelerating device 22, arranged inside the box 13, which comprises a fluid-type decelerating cylinder 23 and return spring means 24 operatively connected with each other.

According to the present invention, the fluid-type decelerating cylinder 23 and the return spring means 24 extend parallel to and spaced apart from each other, with the fluid-type decelerating cylinder arranged in proximity to a first side wall 18' of the box 13 and the return spring means 24 arranged in proximity to the opposite side wall 18' of the box 13, the cylinder 23 and the return means 24 thus arranged separately from each other.

In particular, with reference to the illustrated embodiment in which the closing spring means are in the form of a leaf spring 16, the fluid-type decelerating cylinder 23 and the return spring means 24 extend parallel to and spaced apart from each other along respective opposite sides of the leaf spring 16.

Overall, the decelerating device 22 comprises a retaining or housing body 25 fixable in the hinge box 13 at the front end thereof and a slider 26 slidably arranged at least partially in the retaining body 25 parallel to the bottom wall 17 of the box 13 or else slidably arranged between the retaining body 25 and the bottom wall 17 of the box 13.

The slider 26 is movable between a first extended position, corresponding to the open position of the hinge illustrated in FIG. 7, and a second contracted position corresponding to the closed position of the hinge illustrated in FIG. 9.

Figure 5:
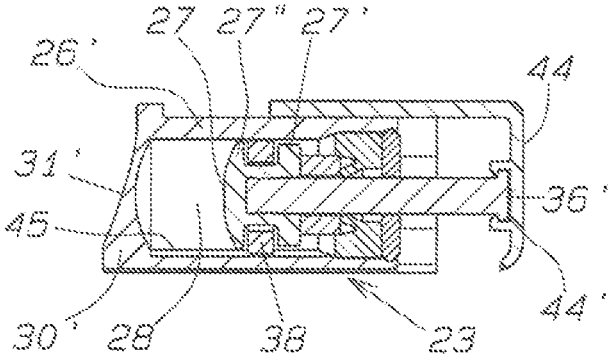
FIG. 5 is a longitudinal sectional view of the decelerating device of FIG. 2 according to the line 5-5.

As better illustrated in FIG. 5, the decelerating cylinder 23 comprises a piston 27 movable in a chamber 28 for the fluid, preferably consisting of oil or another viscous fluid.

Preferably, the slider 26 comprises a first 26' and a second 26" hollow cylindrical parts which are operatively connected with each other, for example by means of a transverse connecting element 29, and extend parallel to and spaced apart from each other, the first hollow cylindrical part 26' defines the chamber 28 for the piston 27 of the decelerating cylinder (23), whilst the second hollow cylindrical part 26" defines a housing seat for the return spring means 24.

For the purpose of actuating the decelerating device, the first and the second cylindrical parts 26', 26" of the slider 26, at an end extending from the retaining body 25 toward the rear end of the box 13, have respective closing walls 30', 30" provided with shaped contact surfaces or cams 31', 31" for contacting corresponding drive surfaces 32', 32" provided on the hinge arm; in particular, with reference to the preferred embodiment illustrated, the driving surfaces 32', 32" extend on bent sections of the front part 21 of the arm 12, at the sides of the opening 20 for the leaf spring 16.

Preferably, the shaped contact surfaces 31', 31" are arc-shaped, with the concavity facing the driving surfaces 32', 32" of the hinge arm 12; by suitably configuring the contact surfaces 31', 31" and in particular by modifying the curvature thereof, it is possible to modulate the braking action according to need and the type of application of the hinge, for example by providing a curvature of the surfaces such as to impose a nearly constant movement of the slider along the swing arc of the hinge during which the braking occurs, or else by providing for an increasing movement of the slider along the swing arc of the hinge toward closing.

In order to guide the sliding of the slider 26, the closing walls 30', 30" of the cylindrical parts 26', 26" of the slider have side guide projections 33 conformed and arranged so as to slide along the respective side walls 18', 18" of the box 13. The cylindrical parts 26', 26" of the slider 26 in turn have side guide surfaces 34 conformed and arranged so as to slide along inner surfaces 35 of the retaining body 25.

In this manner, despite the asymmetry of the arrangement of the return spring 24 in the decelerating device 22, good sliding of the slider 26 is achieved, thus preventing the jamming or blocking thereof.

Figure 6:
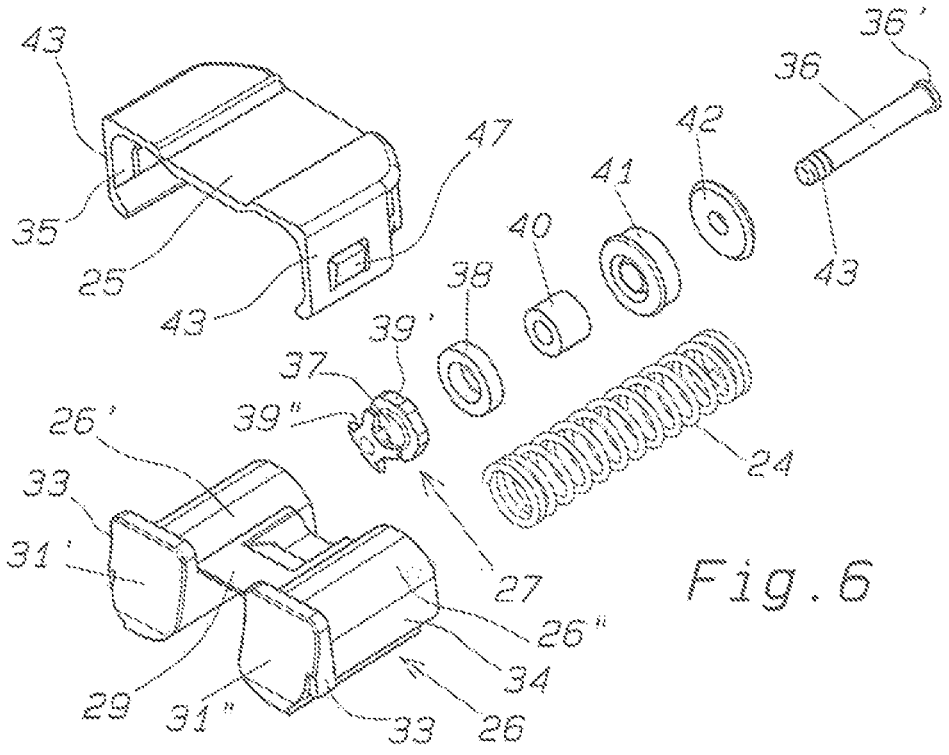
FIG. 6 is an exploded perspective view of the decelerating device of FIG. 2.

As illustrated in FIGS. 5 and 6, with reference to the preferred embodiment in which the slider 26 comprises the aforesaid hollow cylindrical pans 26', 26", the decelerating cylinder 23 comprises the first hollow cylindrical part 26' itself, which defines the chamber 28 for the piston.

The piston 27 includes, on a front side thereof, a blind axial hole for inserting a rod 36 under pressure and peripherally has a annular groove 37 for housing a ring gasket 38; the annular groove 37 is set between a from wall 27' and a rear wall 27" of the piston, which have respective peripheral passages 39', 39" for the fluid, where the rear passages 39" have a greater passage opening to facilitate the return of the device.

For the same purpose, the ring gasket 38 is arranged in the groove 37 with axial and radial slack, the outer surface of the ring gasket 38 being adherent to the inner surface of the chamber 28 of the decelerating cylinder.

The cylinder 23 further comprises a volume-compensating ring element 40, preferably in the form of a closed-cell rubber ring, as well as a ring seal 41, for example of the lip type, for assuring a seal between the piston rod 36 and inner surface of the chamber 28 for the piston.

Finally, the cylinder 23 comprises a ring closing cover 42 for closing the chamber, fixable to the front end of the first cylindrical parts 26', for example by providing a snap-engagable ring-shaped recess for a peripheral edge of the cover 42.

In this configuration, the piston rod 36 extends in succession through the cover 42, the ring seal 41 and the volume-compensating element 40 so as to be inserted under pressure into an axial hole of the piston 27; in order to achieve better retention, the rod 36 has a peripheral toothing or knurling on the end to be press fitted in the axial hole of the piston 27.

The piston rod 36 protrudes at a front end of the first cylindrical part 26' of the slider 26 ending with a head 36' hookable to the retaining body 25 of the device. Preferably, the retaining body 25 has a top and two side walls 43 which extend according to a U-shaped cross section and comprises a front wall 44 provided with a hooking seat 44' for the head 36' of the piston rod 36.

As illustrated in FIG. 5, in order to achieve a smooth, linear operation of the decelerating cylinder 23, the chamber 28 preferably has at least one fluid passage groove 45 longitudinally extending along at least part of the inner surface of the first cylindrical part 26'.

In order to modulate the braking action of the cylinder 23, the opening of the fluid passage groove 45 has a cross section variable along its longitudinal extension.

Figure 4:
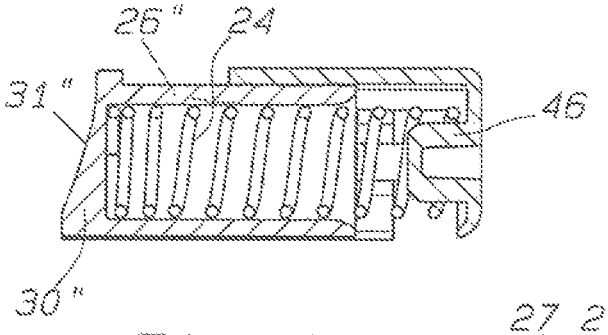
FIG. 4 is a longitudinal sectional view of the decelerating device of FIG. 2 according to the line 4-4.

As illustrated in FIG. 4, the return means 24, serving to bring the slider 26 from the contracted position back into the extended position, preferably comprise a helical spring extending between a reference projection 46 provided on the front wall 44 of the retaining body 25 and the bottom of the second cylindrical part 26" of the slider.

In order to enable a simple, rapid fixing of the decelerating device 22, the retaining body 25 preferably has side spring wings 47 which are snap-engagable in corresponding side openings 48 in the hinge box 13 or vice versa.

The side walls 18', 18" of the box 13 preferably have a first side locking projection 49 for the retaining body 25 in a central area, and a second travel limit projection 50 for the slider 26 in a rear area, both protruding on the inside of the box 13.

Figure 8:
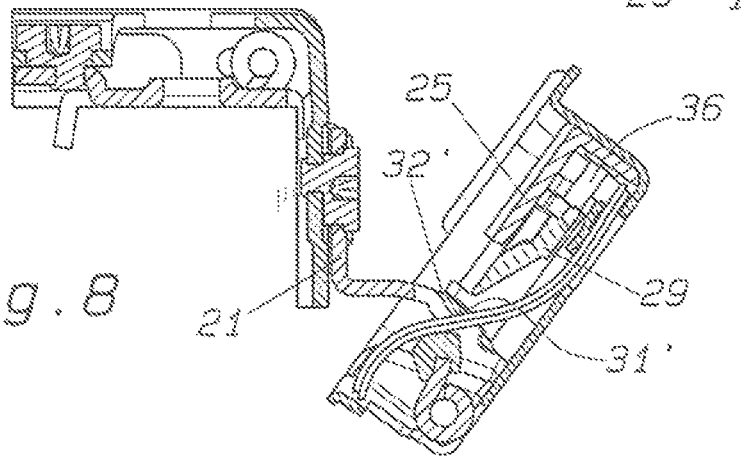
FIG. 8 is a median longitudinal sectional view of the hinge of FIG. 1, wherein the hinge is represented in a partially closed position, in which the driving surfaces provided on the hinge arm come into contact with the contact surfaces of the decelerator.

As illustrated in FIG. 8, during the closing movement of the hinge according to the invention, the driving surfaces 32', 32" of the hinge arm 12 come into contact with the shaped surfaces 31', 31" of the slider 26 at a swing angle of the hinge comprised, for example, between 30' and 40° from the completely closed position of the same illustrated in FIG. 9; therefore, already starting from this swing angle of the hinge, the driving surfaces 32', 32" cause the slider 26 to move from the aforesaid extended position to the contracted position, resulting in a wide deceleration arc for the hinge.

From the foregoing it is evident that the decelerated hinge according to the invention has a decelerating device configured in a suitable manner for being associated with closing means which are placed centrally in the hinge box; moreover, the decelerating device is simple in construction and has components that can be easily assembled together.

The hinge according to the invention is susceptible of numerous modifications and variants falling within the scope of the inventive concept; moreover, all the construction details may be replaced with other technically equivalent ones.

The invention claimed is:

1. A hinge for mounting a door on a piece of furniture, the hinge comprising:

a hinge arm fixable to a fixed part of the piece of furniture;

a box fixable to a door of the piece of furniture, the box being swingably connected to said hinge arm at a rear longitudinal end of the box and having side walls longitudinally extending on opposite sides of the box starting from said rear end;

spring means for closing the hinge; and a linear-type decelerating device arranged inside the box, the decelerating device comprising a fluid-type decelerating cylinder and return spring means operatively connected with each other;

wherein said fluid-type decelerating cylinder and said return spring means extend parallel and spaced apart with each other, wherein said fluid-type decelerating cylinder is arranged in proximity to a first of said side walls of the box and said return spring means is arranged in proximity to the opposite side wall of the box.

2. The hinge according to claim 1, wherein said spring means for closing the hinge comprises at least one leaf spring arranged centrally and longitudinally inside the box, wherein said fluid-type decelerating cylinder and said return spring means extend parallel to and spaced apart from each other on respective opposite sides of said at least one leaf spring.

3. The hinge according to claim 1, wherein said decelerating device further comprises:

a retaining body fixable in said hinge box at a front end; and a slider slidably arranged in said retaining body parallel to a bottom wall of said box, or between said retaining body and said bottom wall.

4. The hinge according to claim 3, wherein said retaining body has side spring wings which are snap-engageable in corresponding side openings in said box, or vice versa.

5. The hinge according to claim 3, wherein said fluid-type decelerating cylinder comprises a piston movable in a chamber for the fluid, and wherein said slider comprises first and second hollow cylindrical parts operatively connected with each other, and which extend parallel to and spaced apart from each other, said first hollow cylindrical part defining said chamber for the piston of the decelerating cylinder, said second hollow cylindrical part defining a housing seat for the return spring means.

6. The hinge (10) according to claim 5, wherein the piston of the decelerating cylinder has a rod protruding at a front end of said first cylindrical part of the slider, and wherein said retaining body of the decelerating device has a top and two side walls extending according to a U-shaped cross section and comprises a front wall provided with a hooking seat for a head of a rod of said piston.

7. The hinge according to claim 6, wherein said return spring means comprises a helical spring extending between a reference projection provided on said front wall of the retaining body and the bottom of the second cylindrical part of the slider.

8. The hinge according to claim 5, wherein said decelerating cylinder comprises:

said first cylindrical part of the slider defining a chamber for the piston;

said piston, the piston having an annular groove and peripheral passages for the fluid;

a ring gasket arranged in said annular piston groove;

a volume-compensating ring element;

a ring seal between a piston rod and the inner surface of said piston chamber; and a ring closing cover for closing said piston chamber, the ring closing cover fixable to the front end of the first cylindrical part;

wherein the piston rod extends through the cover, the seal and the volume-compensating element to be press fitted in a blind axial hole of said piston.

9. The hinge according to claim 8, wherein said piston chamber has at least a fluid passage groove longitudinally extending along at least part of the inner surface of the first cylindrical part.

10. The hinge according to claim 9, wherein the opening of said fluid passage groove has a cross section variable along its longitudinal extension.

11. The hinge according to claim 8, wherein said annular piston groove is arranged between a front wall and a rear wall of the piston, said rear wall having peripheral passages for the fluid having opening greater than that of passages for the fluid provided on the front wall.

12. The hinge according to claim 8, wherein said ring gasket of the piston is arranged in said annular groove with axial and radial slack, the outer surface of the ring gasket adhering to the inner surface of the chamber of the decelerating cylinder.

13. The hinge according to claim 8, wherein said piston rod has a peripheral toothing or knurling on the end to be press fitted in the axial hole of said piston.

14. The hinge according to claim 5, wherein said first and said second hollow cylindrical parts of the slider, at an end extending from said retaining body towards said rear end of the box, have respective closing walls provided with shaped contact surfaces

15. The hinge according to claim 14, wherein said drive surfaces are provided on bent parts of the hinge arm arranged on the sides of said spring means for closing the hinge.

16. The hinge according to claim 14, wherein said closing walls of the cylindrical parts of the slider have side guide projections conformed and arranged for sliding along the respective side walls of the box.

17. The hinge according to claim 14, wherein said cylindrical parts of the slider have side guide surfaces conformed and arranged for sliding along inner surfaces of said retaining body.

18. The hinge according to claim 14, wherein said shaped contact surfaces are arc-shaped having concavity facing said drive surfaces of the hinge arm.

* * * * *